US006789597B2

(12) United States Patent
Wen et al.

(10) Patent No.: US 6,789,597 B2
(45) Date of Patent: Sep. 14, 2004

(54) ELECTROMAGNETIC CLUTCH-CONTROLLED ELECTRIC BLIND

(75) Inventors: Yu-Che Wen, Taoyuan (TW); Song-He Lui, Kaohsiung (TW); Ya-Wei Hsu, Hsin Chu (TW)

(73) Assignees: Industrial Technology Research Institute, Hsinchu Hsien (TW); Nien Made Enterprise Co., Ltd., Changhua (TW)

( * ) Notice: Subject to any disclaimer, the term of this patent is extended or adjusted under 35 U.S.C. 154(b) by 26 days.

(21) Appl. No.: 10/143,770

(22) Filed: May 14, 2002

(65) Prior Publication Data

US 2003/0168185 A1 Sep. 11, 2003

(30) Foreign Application Priority Data

Mar. 7, 2002 (TW) ..... 91202681 U

(51) Int. Cl.[7] ..... E06B 9/30

(52) U.S. Cl. ..... 160/168.1 P; 160/176.1 P; 160/DIG. 17

(58) Field of Search ..... 160/168.1 P, 176.1 P, 160/188, 1, 7, 9, DIG. 17

(56) References Cited

U.S. PATENT DOCUMENTS

| | | | | |
|---|---|---|---|---|
| 3,310,099 A | * | 3/1967 | Hunter et al. | 160/171 R |
| 3,809,143 A | * | 5/1974 | Ipekgil | 160/168.1 R |
| 4,096,903 A | * | 6/1978 | Ringle | 160/176.1 R |
| 4,503,900 A | * | 3/1985 | Osaka et al. | 160/172 R |
| 4,775,039 A | * | 10/1988 | Sunakawa | 160/331 X |
| 4,914,360 A | * | 4/1990 | Hsieh et al. | 160/DIG. 17 |
| 6,144,177 A | * | 11/2000 | Mao | 160/331 X |
| 6,446,693 B1 | * | 9/2002 | Anderson et al. | 160/168.1 P |

* cited by examiner

*Primary Examiner*—David Purol
(74) *Attorney, Agent, or Firm*—Browdy and Neimark, P.L.L.C.

(57) ABSTRACT

An electromagnetic clutch-controlled electric blind is constructed to include a blind body formed of a headrail defining a receiving chamber, a set of slats, and a bottom rail, a power drive, the power drive including a reversible motor and electromagnetic clutch apparatus connectable to the motor, an amplitude modulation set coupled to the motor for rotation with the motor to lift/lower the slats to the desired elevation, a frequency modulation set coupled to the motor through the electromagnetic clutch apparatus and adapted for controlling tilting angle of the slats.

35 Claims, 7 Drawing Sheets

ELECTROMAGNETIC CLUTCH-CONTROLLED ELECTRIC BLIND

BACKGROUND OF THE INVENTION

1. Field of the Invention

The present invention relates to Venetian blinds and, more specifically, to an electromagnetic clutch-controlled electric blind.

2. Description of the Related Art

A regular Venetian blind comprises headrail, a bottom rail, a plurality of slats arranged in parallel between the headrail and the bottom rail, an amplitude modulation control mechanism for controlling lifting and positioning of the bottom rail to change the extending area of the blind, a frequency modulation control mechanism for controlling the tilting angle of the slats to regulate the light. The amplitude modulation control mechanism comprises an endless lift cord suspended from the headrail at one lateral side for pulling by hand to lift/lower the bottom rail. The frequency modulation control mechanism comprises a frequency modulation member disposed at one lateral side of the blind for permitting rotation by the user to regulate the tilting angle of the slats. When adjusting the elevation of the bottom rail, the user must approach the blind and pull the lift cord by hand with much effort. Further, because the lift cord is not kept out of reach of children, children may pull the lift cord for fun. In case the lift cord is hung on a child's head, a fetal accident may occur.

U.S. Pat. No. 5,103,888 discloses a motor-driven blind, which keeps the lift cord from sight. According to this design, a motor is mounted in the headrail or bottom rail, and controlled by a remote controller to roll up or let off the lift cord. The motor is used to control lifting of the lift cord only. When adjusting the tilting angle of the slats, the user must approach the blind and touch-control a tilting control unit. This operation manner is still not convenient.

SUMMARY OF THE INVENTION

The present invention has been accomplished to provide an electromagnetic clutch-controlled electric blind, which eliminates the aforesaid drawbacks. It is the main object of the present invention to provide an electromagnetic clutch-controlled electric blind, which controls lifting/lowering of the slats and bottom rail of the Venetian blind as well as tilting of the slats. It is another object of the present invention to provide an electromagnetic clutch-controlled electric blind, which is compact, and requires less installation space. It is still another object of the present invention to provide an electromagnetic clutch-controlled electric blind, which is inexpensive to manufacture. To achieve these objects of the present invention, the electromagnetic clutch-controlled electric blind comprises a blind body formed of a headrail, a set of slats, and a bottom rail, a power drive, the power drive including a reversible motor and electromagnetic clutch means connectable to the motor, an amplitude modulation set coupled to the motor for rotation with the motor to lift/lower the slats to the desired elevation, a frequency modulation set coupled to the motor through the electromagnetic clutch means and adapted for controlling tilting angle of the slats.

DETAILED DESCRIPTION OF THE PREFERRED EMBODIMENT

Figure 1:
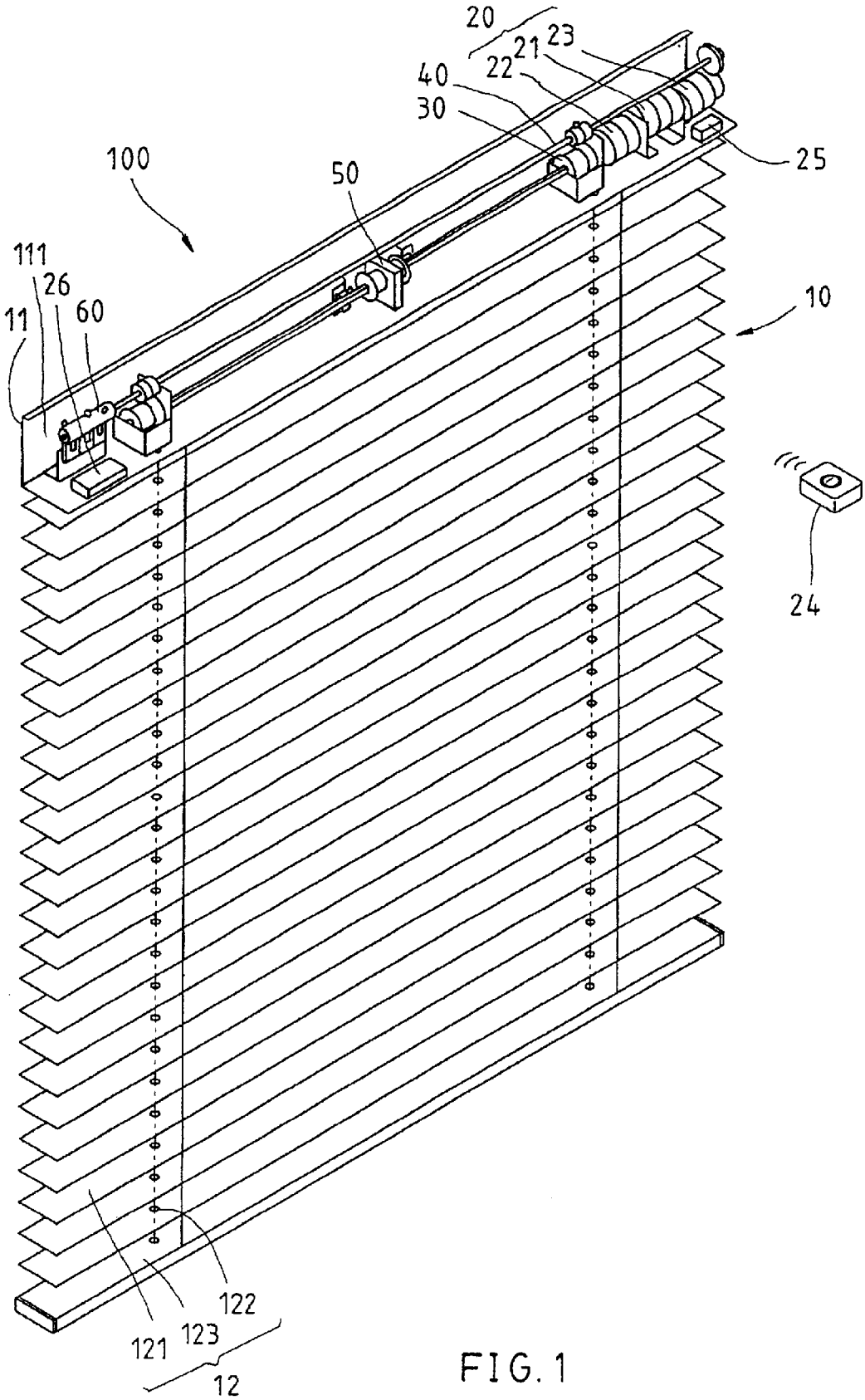
FIG. 1 is a perspective view of an electromagnetic clutch-controlled electric blind according to a first embodiment of the present invention.

Referring to FIG. 1, an electromagnetic clutch-controlled electric blind 100 is shown comprised of a blind body 10, a power drive 20, an amplitude modulation set 30, a frequency modulation set 40, an amplitude modulation detection unit 50, and a frequency modulation detection unit 60.

The blind body 10, as shown in FIG. 1, is a Venetian blind comprised of a headrail 11 and a slat set 12. The headrail 11 is mountable to the top side of a window, comprising an inside holding chamber 111, and two through holes 112 bilaterally disposed at a bottom side in communication with the holding chamber 111. The slat set 12 is comprised of a plurality of slats 121 and a bottom rail 123. Each slat 121 has two through holes 122 corresponding to the through holes 112 of the headrail 11.

The power drive 20 comprises a double side reversible motor 21, two electromagnetic clutches 22;23, a signal transmitter 24, a signal receiver 25, and a battery 26.

Figure 2:
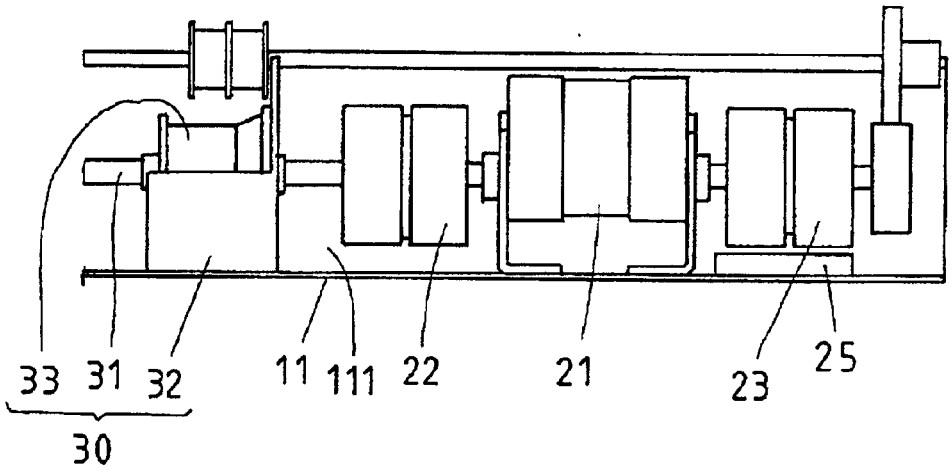
FIG. 2 is a side view in an enlarged scale of a part of the electromagnetic clutch-controlled electric blind shown in FIG. 1.

Referring to FIG. 2, the motor 21 is mounted inside the holding chamber 111 of the headrail 11. The electromagnetic clutches 22;23 are coupled to the motor 21 at two sides to act upon rotation of the motor 21. The signal transmitter 24 can be a remote controller or wired controller for providing control signal to the signal receiver 25. According to the present preferred embodiment, the signal transmitter 24 is a remote controller for providing a radio control signal. The signal receiver 25 is electrically connected to the motor 21 and the electromagnetic clutches 22;23, and adapted to control the operation of the motor 21 and the connection between the motor 21 and the electromagnetic clutches 22;23 subject to the nature of the control signal received from the signal transmitter 24. The battery 25 can be storage battery, dry battery, planar battery, cylindrical battery, or mercury battery mounted inside of the holding chamber 111 and electrically connected to the motor 21 to provide the motor 21 with the necessary working power.

Figure 3:
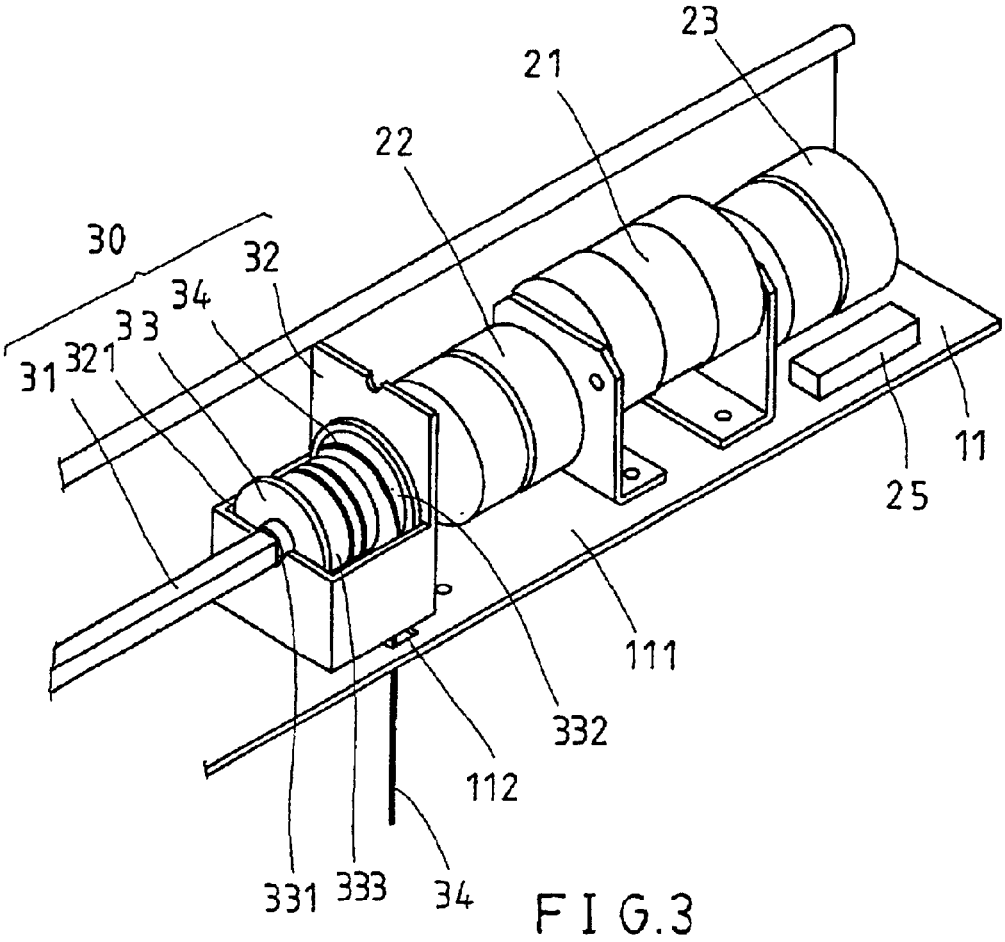
FIG. 3 is an elevational view in an enlarged scale of a part of the electromagnetic clutch-controlled electric blind shown in FIG. 1, showing the arrangement of the power drive and the amplitude modulation set.

Referring to FIGS. 2 and 3, the amplitude modulation set 30 comprises a spindle 31, two holders 32, two bobbins 33, and two amplitude modulation lift cords 34. The spindle 31 is a rod member having a non-circular cross section. According to this embodiment, the spindle 31 is a rectangular rod member having one end coupled to one electromagnetic clutch 22. The holders 32 are fixedly mounted in the holding chamber 111 of the headrail 11 corresponding to the through holes 112 of the headrail 11, each defining a holding chamber 321 respectively disposed in communication with the through holes 112 of the headrail 11. The bobbins 33 are respectively mounted in the holding chambers 321 of the holders 32 for synchronous rotation with the spindle 31. Each bobbin 33 has an axial through hole 331 fitting the cross section of the spindle 31. The peripheral wall of each bobbin 33 defines a lift cord winding face 333 and a conical guide face 332 at one end of the lift cord winding face 333. The conical guide faces 332 of the bobbins 33 are respectively disposed in vertical alignment with the through holes 112 of the headrail 11. Each amplitude modulation lift cord 34 has one end fixedly connected to the end of the lift cord winding face 333 of one bobbin 33, and the other end wound round the lift cord winding face 333 and the conical guide face 332 of the corresponding bobbin 33 and then inserted through one through hole 112 of the headrail 11 and one through hole 122 of each slat 12 and then fixedly connected to the bottom rail 123. By means of rotating the bobbins 33 to roll up or let off the respective amplitude modulation lift cords 34, the bottom rail 123 is lifted or lowered to the desired elevation.

Figure 4:
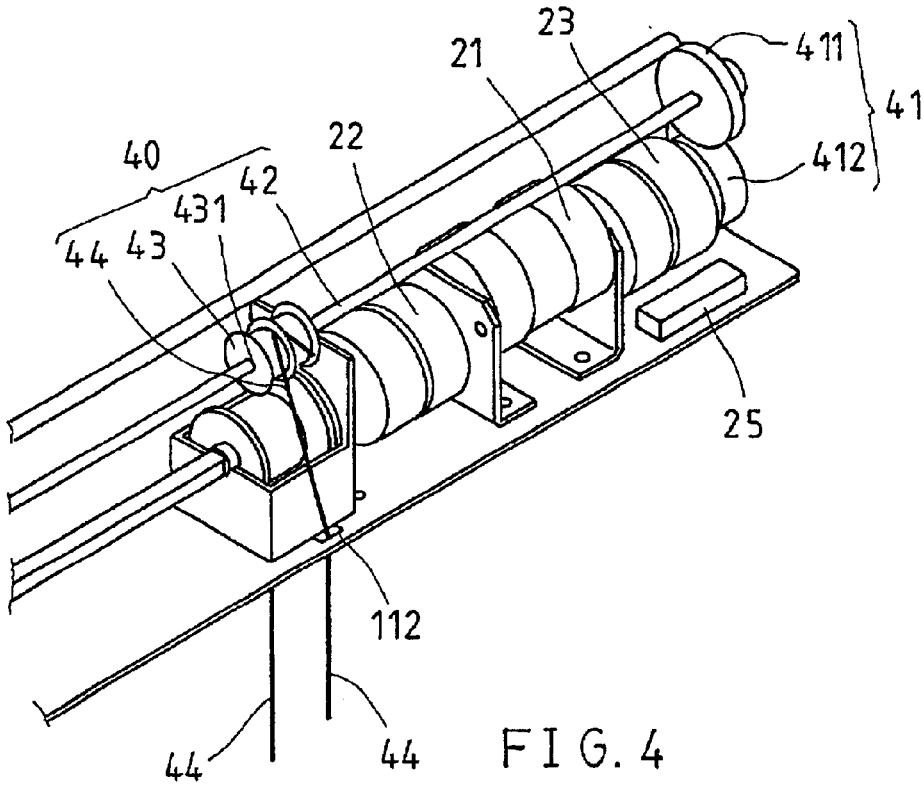
FIG. 4 is an elevational view in an enlarged scale of a part of the electromagnetic clutch-controlled electric blind shown in FIG. 1, showing the arrangement of the power drive, the amplitude modulation set, and the frequency modulation set.

Referring to FIG. 4 and FIG. 1 again, the frequency modulation set 40 is comprised of a transmission gear set 41, a spindle 42, two wheels 43, and two frequency modulation lift cords 44. The transmission gear set 41 is (comprised of a first gear 411 and a second gear 412) coupled to the other electromagnetic clutch 23 and controlled to rotate by the electromagnetic clutch 23. The spindle 42 has one end fixedly connected to the transmission gear set 41, for rotation with the transmission gear set 41. The wheels 43 are respectively mounted on the spindle 42 corresponding to the through holes 112 of the headrail 11 for synchronous rotation with the spindle 42, each having an axial hole 431 that fits the cross section of the spindle 42. The frequency modulation lift cords 44 are respectively wound round the wheels 43, each having two ends respectively inserted through the through holes 112 of the headrail 11 and fixedly connected to the slats 121 and the bottom rail 123 for controlling tilting of the slats 121 to regulate the amount of light passing through the blind 10.

Figure 5:
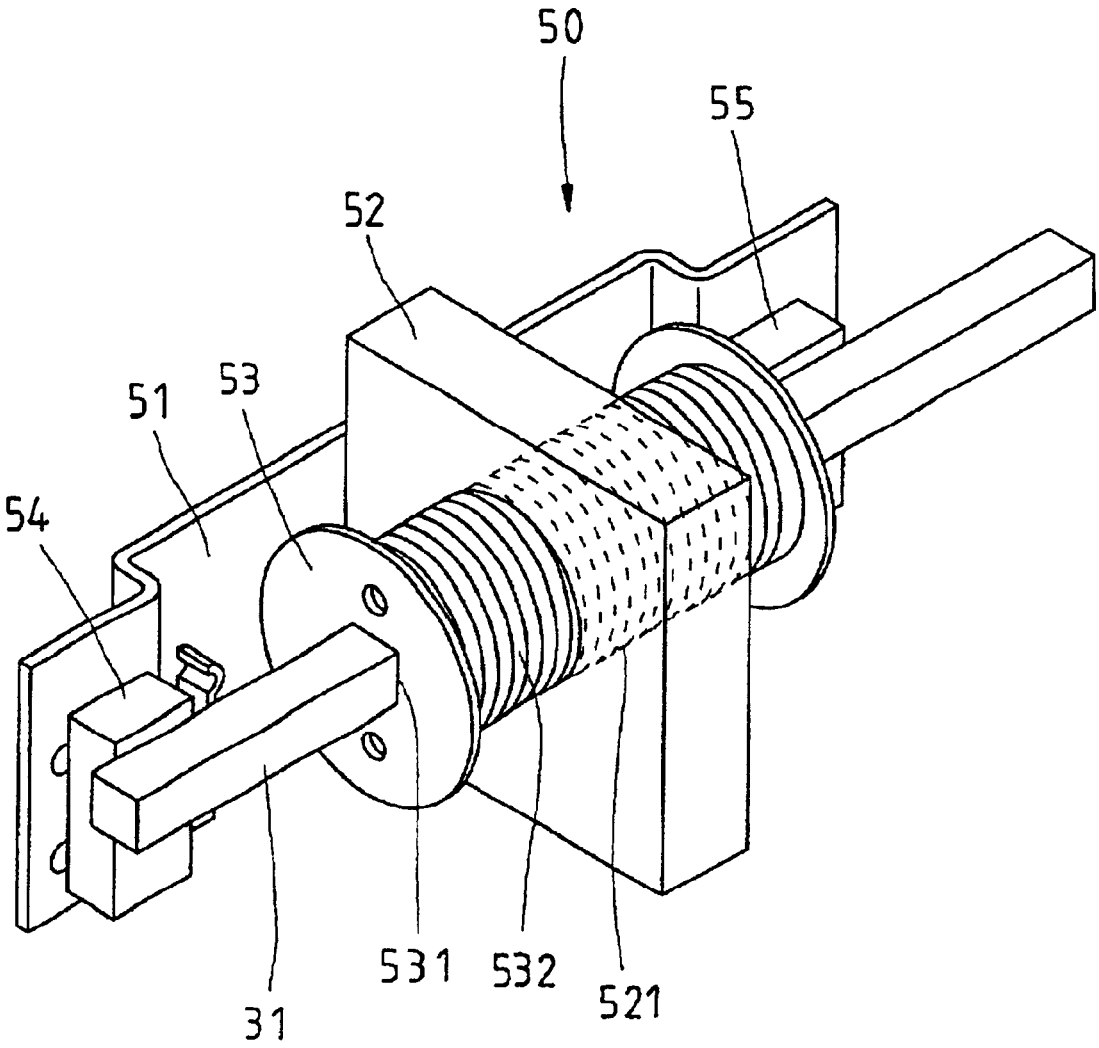
FIG. 5 is an elevational view in an enlarged scale of a part of the electromagnetic clutch-controlled electric blind shown in FIG. 1, showing the arrangement of the amplitude modulation detection unit.

Referring to FIG. 5 and FIG. 1 again, the amplitude modulation detection unit 50 is installed in the holding chamber 111 of the headrail 11 between the holders 32 of the amplitude modulation set 30, and adapted to stop the motor 21 of the power drive 20 when the slats 121 lowered to the lower limit position or lifted to the upper limit position. The amplitude modulation detection unit 50 is comprised of a mounting plate 51, locating block 52, a roller 53, and two limit switches 54;55. The mounting plate 51 is fixedly fastened to the peripheral wall of the holding chamber 111 of the headrail 11. The locating block 52 is fixedly mounted inside the holding chamber 111 of the headrail 11, having a center screw hole 521. The roller 53 is coupled to the spindle 31 of the amplitude modulation set 30 for synchronous rotation, having an outer thread 532 threaded into the center screw hole 521 of the locating block 52. The roller 53 has an axial hole 531 fitting the cross section of the spindle 31. Rotation of the spindle 31 causes synchronous rotation of the roller 53 with the spindle 31 and axial movement of the roller 53 relative to the locating block 52. The limit switches 54;55 are respectively mounted on the mounting plate 51 at two sides relative to the wheel 53 (in positions of the ends of the path of the axial movement of the wheel 53 corresponding to the upper limit position and lower limit position of the slats 121 of the blind 10), and electrically connected to the motor 21. When the slats 121 moved to the upper or lower limit position, the wheel 53 touches one limit switch 54 or 55, thereby causing the limit switch 54 or 55 to stop the motor 21.

Figure 9:
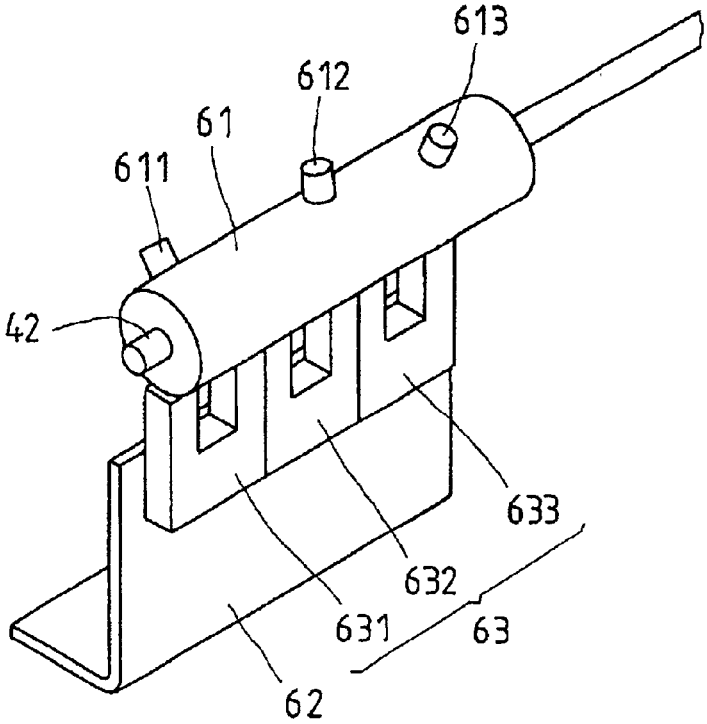
FIG. 9 is an elevational view in an enlarged scale of a part of the first embodiment of the present invention, showing the arrangement of the frequency modulation detection unit.

Referring to FIG. 9 and FIG. 1 again, the frequency modulation detection unit 60 is comprised of a wheel 61, a support 62, and a sensor 63. The wheel 61 is fixedly fastened to one end of the spindle 42 of the frequency modulation set 40 remote from the transmission gear set 41 for synchronous rotation with the spindle 42, having three pins protruded from the periphery at different angles, namely, the left limit position detection pin 611, the horizontal position detection pin 612, and the right limit position detection pin 613. The support 62 is fixedly mounted in the holding chamber 111 of the headrail 11. The sensor 63 is fixedly mounted on the support 62 and electrically connected to the motor 21 of the power drive 20, having a left limit position detection portion 631, a horizontal position detection portion 632, and a right limit position detection portion 633 respectively disposed corresponding to the left limit position detection pin 611, the horizontal position detection pin 612, and the right limit position detection pin 613. During operation of the motor 21 to rotate the spindle 42 of the frequency modulation set 40, the wheel 61 is rotated with the spindle 42. When the slats 121 tilted leftwards to the limit, the left limit position detection pin 611 induces the left limit position detection portion 631, thereby causing the sensor 63 to stop the motor 21. When the slats 121 tilted rightwards to the limit, the right limit position detection pin 613 induces the right limit position detection portion 633, thereby causing the sensor 63 to stop the motor 21.

With respect to the amplitude modulation control of lifting (receiving) the blind, the operation of the present invention is outlined hereinafter. When the user operated the signal transmitter 23 of the power drive 20 to transmit a control signal of lifting the blind, the signal receiver 24 immediately receives the signal. Upon receipt of the signal, the signal receiver 24 switches on one electromagnetic clutch 22 to connect the amplitude modulation set 30 to the motor 21 and switches off the other electromagnetic clutch 23 to disconnect the frequency modulation set 40 from the motor 21 and, at the same time drives the motor 21 to rotate in one direction, thereby causing the spindle 31 of the amplitude modulation set 30 to be rotated with the motor 21. Therefore, the bobbins 33 are rotated with the spindle 31 to roll up the amplitude modulation lift cords 34 along the respective conical guide faces 332 and then the respective lift cord winding faces 333 smoothly to lift the bottom rail 123 and then the slats 121 to the desired elevation. When the slat set 12 received to the upper limit position, the amplitude modulation detection unit 50 is induced to stop the motor 21.

Figure 6:
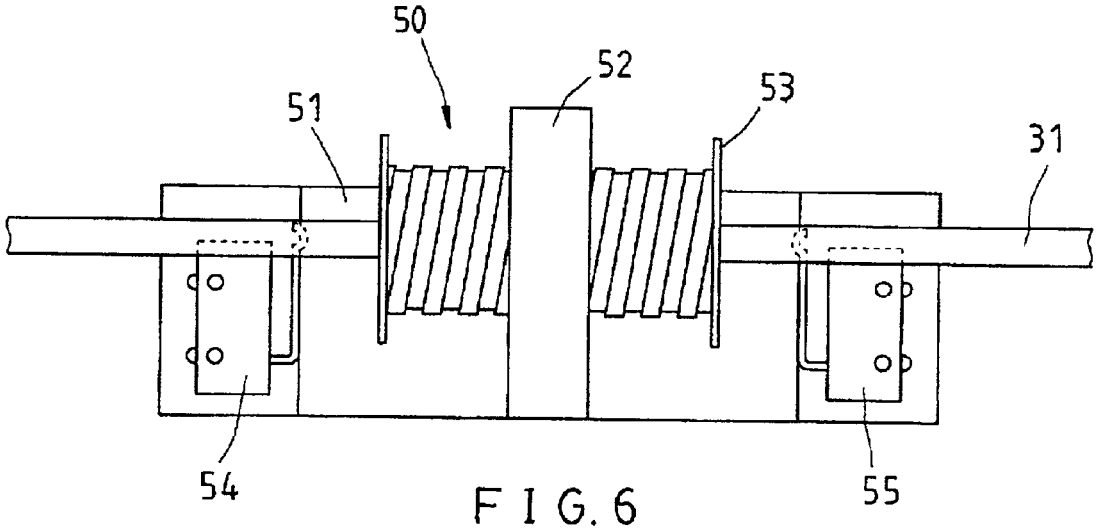
FIGS. 6~8 show the operation of the amplitude modulation set according to the first embodiment of the present invention.
Figure 7:
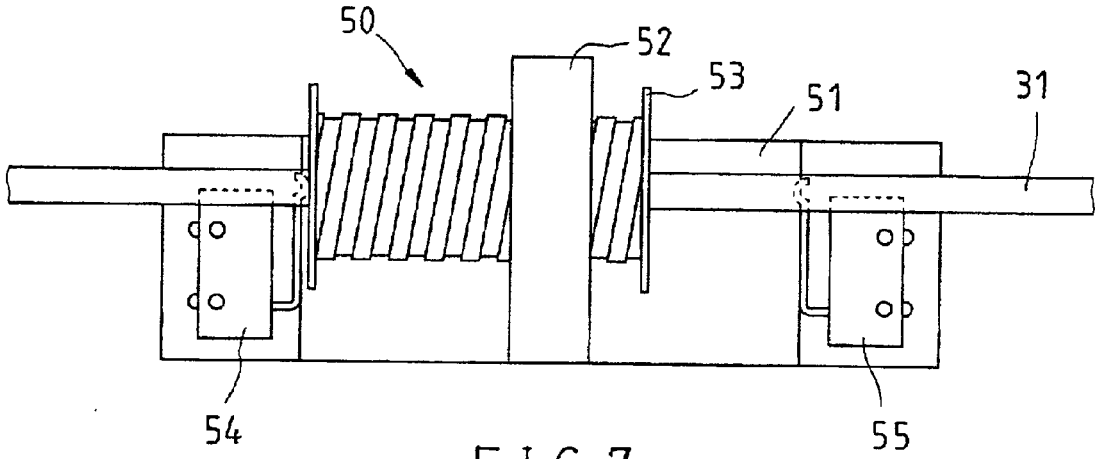
Figure 8:
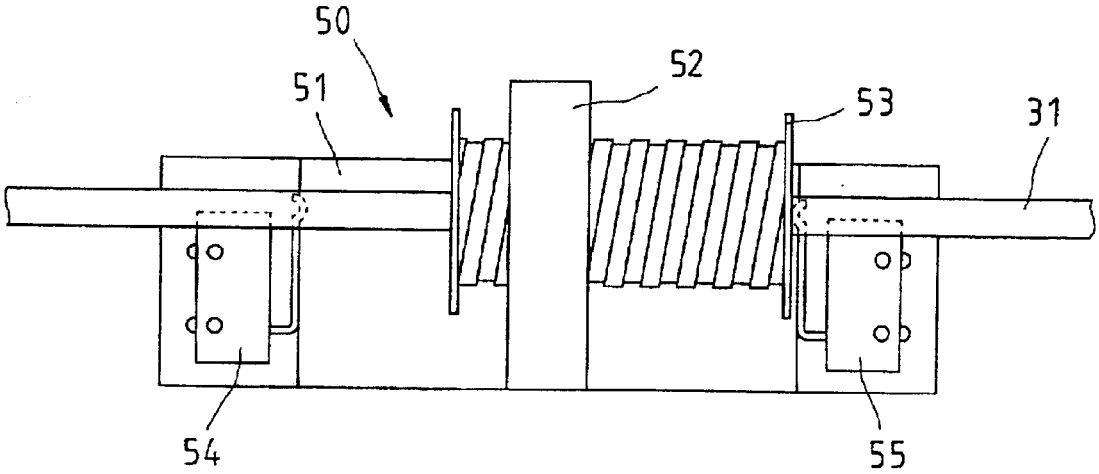

With respect to the amplitude modulation control of lowering (extending out) the blind, the operation of the present invention is outlined hereinafter. When the user operated the signal transmitter 23 of the power drive 20 to transmit a control signal of lowering the blind, the signal receiver 24 immediately receives the signal. Upon receipt of the signal, the signal receiver 24 switches on one electromagnetic clutch 22 to connect the amplitude modulation set 30 to the motor 21 and switches off the other electromagnetic clutch 23 to disconnect the frequency modulation set 40 from the motor 21 and, at the same time drives the motor 21 to rotate in the reversed direction, thereby causing the spindle 31 of the amplitude modulation set 30 to be rotated with the motor 21. Therefore, the bobbins 33 are rotated with the spindle 31 to let off the amplitude modulation lift cords 34 and to further lower the bottom rail 123 and the slats 121. When the slat set 12 lowered to the lower limit position, the amplitude modulation detection unit 50 is induced to stop the motor 21 (see FIGS. 6~8).

With respect to the control of tilting of the slats 121, the operation is described hereinafter. At first, the user operates the signal transmitter 23 to transmit a slat tilting control signal to the signal receiver 24. Upon receipt of the control signal, the signal receiver 24 immediately switches off one electromagnetic clutch 22 to disconnect the amplitude modulation set 30 from the motor 21 and switches on the other electromagnetic clutch 23 to connect the frequency modulation set 40 to the motor 21 and, at the same time drives the motor 21 to rotate in one direction, thereby causing the transmission gear set 41 to rotate the spindle 42 and the wheels 43 f the frequency modulation set 40, so as to turn the frequency modulation lift cords 44 in tilting the slats 121. When the slats 121 tilted to the left or right limit position, the left limit position detection pin 611 or right limit position detection pin 613 of the frequency modulation detection unit 60 immediately stops the motor 21.

Further, when receiving or extending out the slats 121, the signal receiver 25 switches on the electromagnetic clutch 23 to connect the frequency modulation set 40 to the motor 21, for enabling the slats 121 to be automatically regulated to the horizontal position (by means of the control of the relative action between the horizontal position pin 612 and the horizontal position detection portion 632), i.e., when the horizontal position pin 612 and the horizontal position detection portion 632 matched, the electromagnetic clutch 23 is switched off to disconnect the frequency modulation set 40 from the motor 21 and the electromagnetic clutch 22 is switched on to connect the amplitude modulation set 30 to the motor 21 before adjusting the slats 121.

Figure 10:
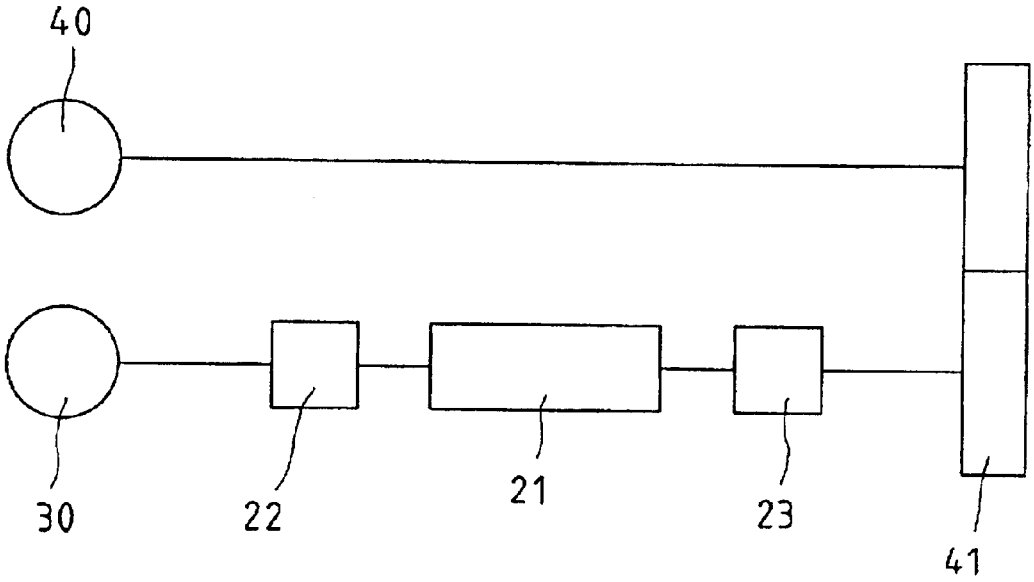
FIG. 10 is a system block diagram of the first embodiment of the present invention.

Based on the above description, the present invention can be explained by means of the system block diagram of FIG. 10. As illustrated, the two sides of the motor 21 are respectively connected to the amplitude modulation set 30 and the frequency modulation set 40 by the electromagnetic clutches 22;23. One single driving source is sufficient to drive the amplitude modulation set 30 and the frequency modulation set 40.

Figure 11:
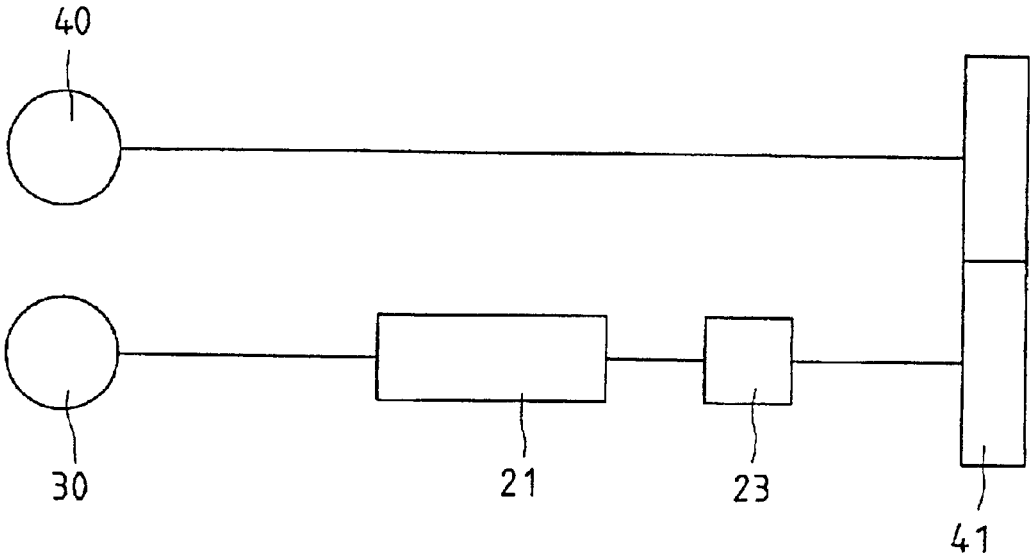
FIG. 11 is a system block diagram of a second embodiment of the present invention.

FIG. 11 is a system block diagram showing a second embodiment of the present invention. According to this embodiment, the amplitude modulation set 30 is directly coupled to the motor 21, and the frequency modulation set 40 is coupled to the motor 21 through the transmission gear set 41 and the electromagnetic clutch 23. When lifting/lowering the slats, switch off the electromagnetic clutch 23 to disconnect the frequency modulation set 40 from the motor 21. When tilting the slats, switch on the electromagnetic clutch 23 to connect the frequency modulation set 40 to the motor 21. At this time, the amplitude modulation set 30 moves slightly following the action of the frequency modulation set 40. However, because this movement causes the bottom rail to be lifted or lowered within a short distance only, this insignificant amount of movement does not affect the reliability of the operation.

Figure 12:
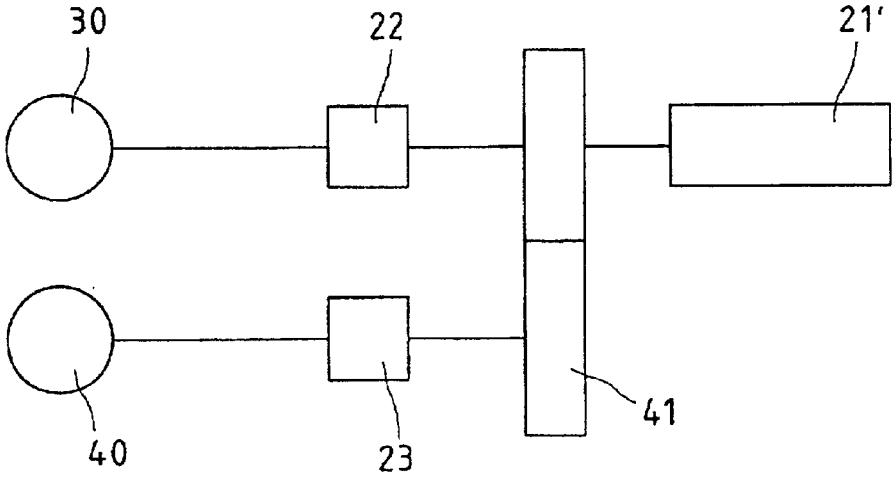
FIG. 12 is a system block diagram of a third embodiment of the present invention.

FIG. 12 is a system block diagram showing a third embodiment of the present invention. According to this embodiment, the motor 21' is a single side motor coupled to the transmission gear set 41; the amplitude modulation set 30 and the frequency modulation set 40 are connected in parallel to the transmission gear set 41 through the electromagnetic clutches 22;23 respectively.

Figure 13:
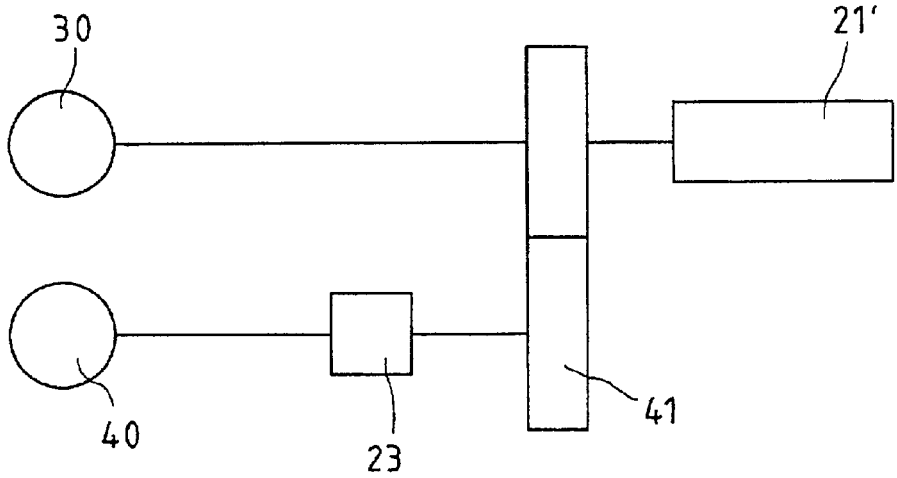
FIG. 13 is a system block diagram of a fourth embodiment of the present invention.

FIG. 13 is a system block diagram showing a fourth embodiment of the present invention. According to this embodiment, the motor 21' is a single side motor coupled to the transmission gear set 41; the amplitude modulation set 30 is directly connected to the transmission gear set 41; the frequency modulation set 40 is connected to the transmission gear set 41 through the electromagnetic clutch 23.

Figure 14:
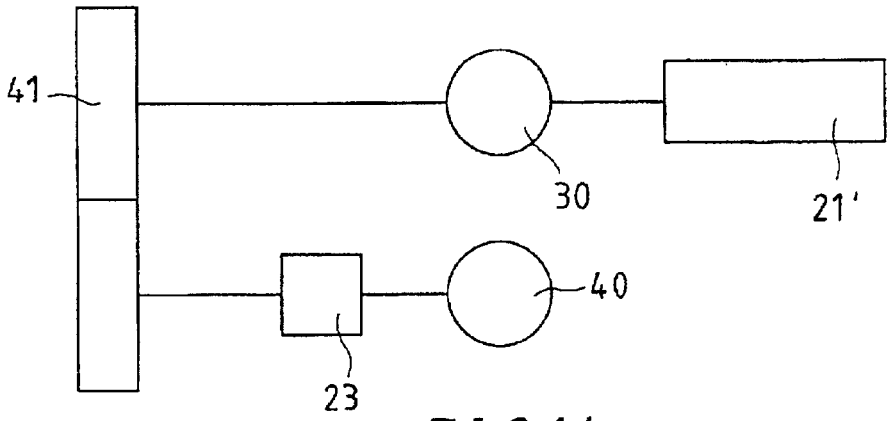
FIG. 14 is a system block diagram of a fifth embodiment of the present invention.

FIG. 14 is a system block diagram showing a fifth embodiment of the present invention. According to this embodiment, the amplitude modulation set 30 is coupled between the single side motor 21' and the transmission gear set 41, and the frequency modulation set 40 is coupled to the transmission gear set 41 through the electromagnetic clutch 23.

The structure and function of the present invention are well understood from the aforesaid detailed description. The advantages of the present invention are outlined hereinafter.

1. Slat lifting and tilting dual-control function:

Two electromagnetic clutches are used to couple the amplitude modulation set, which controls lifting of the slats, and the frequency modulation set, which controls tilting of the slats, to the motor, enabling the amplitude modulation set and the frequency modulation set to be driven by motor to lift or tilt the slats.

2. Single driving source and compact size:

Because two electromagnetic clutches are used to control connection of the amplitude modulation set and the frequency modulation set, one single driving source is sufficient to drive the amplitude modulation set and the frequency modulation set. Therefore, the invention is inexpensive, and requires less installation space.

3. Durable mechanical design:

The electromagnetic clutch-controlled electric blind is provided with detector means to detect the positioning of the slats and to automatically stop the motor when the slats moved to the limit in each mode, preventing damage to the parts of the mechanism.

What the invention claimed is:

1. An electromagnetic clutch-controlled electric blind comprising:

a blind body, said blind body having a headrail and a slat set, said headrail having an internal holding chamber, said slat set having a plurality of slats;

a power drive, said power drive having a reversible motor, and at least one electromagnetic clutch controlled between a first position coupled to said motor and a second position disconnected from said motor;

an amplitude modulation set, said amplitude modulation set having a spindle coupled to said motor for rotation with said motor to lift/lower said slats to the desired elevation;

a frequency modulation set, said frequency modulation set having a spindle coupled to said motor through said electromagnetic clutch and adapted for controlling tilting angle of said slats;

further comprising an amplitude modulation detection unit mounted in the internal holding chamber of said headrail and adapted to stop said motor when said amplitude modulation detection unit lifted/lowered said slats to a limit position; and wherein said amplitude modulation detection unit comprises a locating block fixedly mounted in the internal holding chamber of said headrail, said locating block having a center screw hole, two limit switches provided inside the internal holding chamber of said headrail and disposed at two sides relative to said locating block, a roller fixedly mounted on the spindle of said amplitude modulation set for synchronous rotation and threaded into the center screw hole of said locating block for axial movement between said limit switches to trigger said limit switches to stop said motor when touched one of said limit switch upon rotation of the spindle of said amplitude modulation set.

2. The electromagnetic clutch-controlled electric blind as claimed in claim 1, wherein said motor is a single side reversible motor.

3. The electromagnetic clutch-controlled electric blind as claimed in claim 1, wherein said motor is a double side reversible motor.

4. The electromagnetic clutch-controlled electric blind as claimed in claim 1, the spindle of said amplitude modulation set is coupled to said motor through a electromagnetic clutch.

5. The electromagnetic clutch-controlled electric blind as claimed in claim 1, wherein said power drive further comprises a transmission gear set coupled between said motor and said amplitude modulation set.

6. The electromagnetic clutch-controlled electric blind as claimed in claim 1, further comprising a frequency modulation detection unit mounted in the internal holding chamber of said headrail and adapted to stop said motor when said frequency modulation set tilted said slats to a limit angular position.

7. The electromagnetic clutch-controlled electric blind as claimed in claim 6, wherein said frequency modulation detection unit comprises a wheel fixedly fastened to one end of the spindle of said frequency modulation set for synchronous rotation, the wheel of said frequency modulation detection unit having a left limit position detection pin, a horizontal position detection pin, and a right limit position detection pin, and a sensor mounted in the internal holding chamber of said headrail and electrically connected to said motor of said power drive, said sensor having a left limit position detection portion, a horizontal position detection portion, and a right limit position detection portion respectively disposed corresponding to the left limit position detection pin, horizontal position detection pin, and right limit position detection pin of the wheel of said frequency modulation detection unit; when said motor started to drive said frequency modulation set to tilt said slats leftwards to a left limit angular position, said left limit position detection pin induces said left limit position detection portion, thereby causing sensor to stop said motor; when said motor started to drive said frequency modulation set to tilt said slats rightwards to a right limit angular position, said right limit position detection pin induces said right limit position detection portion, thereby causing sensor to stop said motor.

8. The electromagnetic clutch-controlled electric blind as claimed in claim 1, wherein said power drive further comprises a signal transmitter adapted to transmit one of a series of control signals, a signal receiver electrically connected to said motor and said at least one electromagnetic clutch and adapted to receive a control signal from said signal transmitter and to switch on/off said at least one electromagnetic clutch and said motor subject to the control signal received, and a battery electrically connected to said motor and said at least one electromagnetic clutch to provide the necessary working power.

9. The electromagnetic clutch-controlled electric blind as claimed in claim 1, wherein said amplitude modulation set further comprises two holders fixedly mounted in the internal holding chamber of said headrail, two bobbins respectively mounted in said holders and fixedly mounted on the spindle of said amplitude modulation set for synchronous rotation, and two amplitude modulation lift cords, said amplitude modulation lift cords connected in parallel between said the bobbins of said amplitude modulation set and said bottom rail.

10. The electromagnetic clutch-controlled electric blind as claimed in claim 9, wherein each bobbin of said amplitude modulation set defines a lift cord winding face and a conical guide face at one end of said lift cord winding face for guiding winding of the corresponding amplitude modulation lift cord on the corresponding bobbin.

11. The electromagnetic clutch-controlled electric blind as claimed in claim 1, wherein said frequency modulation set further comprises a transmission gear set fixedly connected to the spindle of said frequency modulation set and coupled to said motor through one of said at least one electromagnetic clutch, two wheels respectively mounted on the spindle of said frequency modulation set for synchronous rotation, and two frequency modulation lift cords respectively wound round the wheels of said frequency modulation set, said frequency modulation lift cords each having two ends respectively connected in parallel to said slats and said bottom rail.

12. An electromagnetic clutch-controlled electric blind comprising:

a blind body, said blind body having a headrail and a slat set, said headrail having an internal holding chamber, said slat set having a plurality of slats;

a power drive, said power drive having a reversible motor, and at least one electromagnetic clutch controlled between a first position coupled to said motor and a second position disconnected from said motor;

an amplitude modulation set, said amplitude modulation set having a spindle coupled to said motor for rotation with said motor to lift/lower said slats to the desired elevation;

a frequency modulation set, said frequency modulation set having a spindle coupled to said motor through said electromagnetic clutch and adapted for controlling tilting angle of said slats;

further comprising a frequency modulation detection unit mounted in the internal holding chamber of said headrail and adapted to stop said motor when said frequency modulation set tilted said slats to a limit angular position; and wherein said frequency modulation detection unit comprises a wheel fixedly fastened to one end of the spindle of said frequency modulation set for synchronous rotation, the wheel of said frequency modulation detection unit having a left limit position detection pin, a horizontal position detection pin, and a right limit position detection pin, and a sensor mounted in the internal holding chamber of said headrail and electrically connected to said motor of said power drive, said sensor having a left limit position detection portion, a horizontal position detection portion, and a right limit position detection portion respectively disposed corresponding to the left limit position detection pin, horizontal position detection pin, and right limit position detection pin of the wheel of said frequency modulation detection unit; when said motor started to drive said frequency modulation set to tilt said slats leftwards to a left limit angular position, said left limit position detection pin induces said left limit position detection portion, thereby causing sensor to stop said motor; when said motor started to drive said frequency modulation set to tilt said slats rightwards to a right limit angular position, said right limit position detection pin induces said right limit position detection portion, thereby causing sensor to stop said motor.

13. The electromagnetic clutch-controlled electric blind as claimed in claim 12, wherein said motor is a single side reversible motor.

14. The electromagnetic clutch-controlled electric blind as claimed in claim 12, wherein said motor is a double side reversible motor.

15. The electromagnetic clutch-controlled electric blind as claimed in claim 12, the spindle of said amplitude modulation set is coupled to said motor through a electromagnetic clutch.

16. The electromagnetic clutch-controlled electric blind as claimed in claim 12, wherein said power drive further comprises a transmission gear set coupled between said motor and said amplitude modulation set.

17. The electromagnetic clutch-controlled electric blind as claimed in claim 12, further comprising an amplitude modulation detection unit mounted in the internal holding chamber of said headrail and adapted to stop said motor when said amplitude modulation detection unit lifted/lowered said slats to a limit position.

18. The electromagnetic clutch-controlled electric blind as claimed in claim 17, wherein said amplitude modulation detection unit comprises a locating block fixedly mounted in the internal holding chamber of said headrail, said locating block having a center screw hole, two limit switches provided inside the internal holding chamber of said headrail and disposed at two sides relative to said locating block, a roller fixedly mounted on the spindle of said amplitude modulation set for synchronous rotation and threaded into the center screw hole of said locating block for axial movement between said limit switches to trigger said limit switches to stop said motor when touched one of said limit switch upon rotation of the spindle of said amplitude modulation set.

19. The electromagnetic clutch-controlled electric blind as claimed in claim 12, wherein said power drive further comprises a signal transmitter adapted to transmit one of a series of control signals, a signal receiver electrically connected to said motor and said at least one electromagnetic clutch and adapted to receive a control signal from said signal transmitter and to switch on/off said at least one electromagnetic clutch and said motor subject to the control signal received, and a battery electrically connected to said motor and said at least one electromagnetic clutch to provide the necessary working power.

20. The electromagnetic clutch-controlled electric blind as claimed in claim 12, wherein said amplitude modulation set further comprises two holders fixedly mounted in the internal holding chamber of said headrail, two bobbins respectively mounted in said holders and fixedly mounted on the spindle of said amplitude modulation set for synchronous rotation, and two amplitude modulation lift cords, said amplitude modulation lift cords connected in parallel between said the bobbins of said amplitude modulation set and said bottom rail.

21. The electromagnetic clutch-controlled electric blind as claimed in claim 20, wherein each bobbin of said amplitude modulation set defines a lift cord winding face and a conical guide face at one end of said lift cord winding face for guiding winding of the corresponding amplitude modulation lift cord on the corresponding bobbin.

22. The electromagnetic clutch-controlled electric blind as claimed in claim 12, wherein said frequency modulation set further comprises a transmission gear set fixedly connected to the spindle of said frequency modulation set and coupled to said motor through one of said at least one electromagnetic clutch, two wheels respectively mounted on the spindle of said frequency modulation set for synchronous rotation, and two frequency modulation lift cords respectively wound round the wheels of said frequency modulation set, said frequency modulation lift cords each having two ends respectively connected in parallel to said slats and said bottom rail.

23. An electromagnetic clutch-controlled electric blind comprising:

a blind body, said blind body having a headrail and a slat set, said headrail having an internal holding chamber, said slat set having a plurality of slats;

a power drive, said power drive having a reversible motor, and at least one electromagnetic clutch controlled between a first position coupled to said motor and a second position disconnected from said motor;

an amplitude modulation set, said amplitude modulation set having a spindle coupled to said motor for rotation with said motor to lift/lower said slats to the desired elevation;

a frequency modulation set, said frequency modulation set having a spindle coupled to said motor through said electromagnetic clutch and adapted for controlling tilting angle of said slats;

wherein said amplitude modulation set further comprises two holders fixedly mounted in the internal holding chamber of said headrail, two bobbins respectively mounted in said holders and fixedly mounted on the spindle of said amplitude modulation set for synchronous rotation, and two amplitude modulation lift cords, said amplitude modulation lift cords connected in parallel between said the bobbins of said amplitude modulation set and said bottom rail; and wherein each bobbin of said amplitude modulation set defines a lift cord winding face and a conical guide face at one end of said lift cord winding face for guiding winding of the corresponding amplitude modulation lift cord on the corresponding bobbin.

24. The electromagnetic clutch-controlled electric blind as claimed in claim 23, wherein said motor is a single side reversible motor.

25. The electromagnetic clutch-controlled electric blind as claimed in claim 23, wherein said motor is a double side reversible motor.

26. The electromagnetic clutch-controlled electric blind as claimed in claim 23, the spindle of said amplitude modulation set is coupled to said motor through a electromagnetic clutch.

27. The electromagnetic clutch-controlled electric blind as claimed in claim 26, further comprising an amplitude modulation detection unit mounted in the internal holding chamber of said headrail and adapted to stop said motor when said amplitude modulation detection unit lifted/lowered said slats to a limit position.

28. The electromagnetic clutch-controlled electric blind as claimed in claim 23, wherein said power drive further comprises a transmission gear set coupled between said motor and said amplitude modulation set.

29. The electromagnetic clutch-controlled electric blind as claimed in claim 28, wherein said amplitude modulation detection unit comprises a locating block fixedly mounted in the internal holding chamber of said headrail, said locating block having a center screw hole, two limit switches provided inside the internal holding chamber of said headrail and disposed at two sides relative to said locating block, a roller fixedly mounted on the spindle of said amplitude modulation set for synchronous rotation and threaded into the center screw hole of said locating block for axial movement between said limit switches to trigger said limit switches to stop said motor when touched one of said limit switch upon rotation of the spindle of said amplitude modulation set.

30. The electromagnetic clutch-controlled electric blind as claimed in claim 23, further comprising a frequency modulation detection unit mounted in the internal holding chamber of said headrail and adapted to stop said motor when said frequency modulation set tilted said slats to a limit angular position.

31. The electromagnetic clutch-controlled electric blind as claimed in claim 30, wherein said frequency modulation detection unit comprises a wheel fixedly fastened to one end of the spindle of said frequency modulation set for synchronous rotation, the wheel of said frequency modulation detection unit having a left limit position detection pin, a horizontal position detection pin, and a right limit position detection pin, and a sensor mounted in the internal holding chamber of said headrail and electrically connected to said motor of said power drive, said sensor having a left limit position detection portion, a horizontal position detection portion, and a right limit position detection portion respectively disposed corresponding to the left limit position detection pin, horizontal position detection pin, and right limit position detection pin of the wheel of said frequency modulation detection unit; when said motor started to drive said frequency modulation set to tilt said slats leftwards to a left limit angular position, said left limit position detection pin induces said left limit position detection portion, thereby causing sensor to stop said motor; when said motor started to drive said frequency modulation set to tilt said slats rightwards to a right limit angular position, said right limit position detection pin induces said right limit position detection portion, thereby causing sensor to stop said motor.

32. The electromagnetic clutch-controlled electric blind as claimed in claim 23, wherein said power drive further comprises a signal transmitter adapted to transmit one of a series of control signals, a signal receiver electrically connected to said motor and said at least one electromagnetic clutch and adapted to receive a control signal from said signal transmitter and to switch on/off said at least one electromagnetic clutch and said motor subject to the control signal received, and a battery electrically connected to said motor and said at least one electromagnetic clutch to provide the necessary working power.

33. The electromagnetic clutch-controlled electric blind as claimed in claim 23, wherein said amplitude modulation set further comprises two holders fixedly mounted in the internal holding chamber of said headrail, two bobbins respectively mounted in said holders and fixedly mounted on the spindle of said amplitude modulation set for synchronous rotation, and two amplitude modulation lift cords, said amplitude modulation lift cords connected in parallel between said the bobbins of said amplitude modulation set and said bottom rail.

34. The electromagnetic clutch-controlled electric blind as claimed in claim 33, wherein each bobbin of said amplitude modulation set defines a lift cord winding face and a conical guide face at one end of said lift cord winding face for guiding winding of the corresponding amplitude modulation lift cord on the corresponding bobbin.

35. The electromagnetic clutch-controlled electric blind as claimed in claim 23, wherein said frequency modulation set further comprises a transmission gear set fixedly connected to the spindle of said frequency modulation set and coupled to said motor through one of said at least one electromagnetic clutch, two wheels respectively mounted on the spindle of said frequency modulation set for synchronous rotation, and two frequency modulation lift cords respectively wound round the wheels of said frequency modulation set, said frequency modulation lift cords each having two ends respectively connected in parallel to said slats and said bottom rail.

* * * * *